US009536469B2

(12) United States Patent
Li et al.

(10) Patent No.: US 9,536,469 B2
(45) Date of Patent: Jan. 3, 2017

(54) PULSE SIGNAL COMBINATION CIRCUIT, DISPLAY PANEL AND DISPLAY DEVICE

(71) Applicant: BOE TECHNOLOGY GROUP CO., LTD, Beijing (CN)

(72) Inventors: Quanhu Li, Beijing (CN); Chen Song, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 12 days.

(21) Appl. No.: 14/769,068

(22) PCT Filed: Jan. 6, 2015

(86) PCT No.: PCT/CN2015/070193

§ 371 (c)(1),
(2) Date: Aug. 19, 2015

(87) PCT Pub. No.: WO2016/045247

PCT Pub. Date: Mar. 31, 2016

(65) Prior Publication Data

US 2016/0253962 A1 Sep. 1, 2016

(30) Foreign Application Priority Data

Sep. 23, 2014 (CN) ..... 2014 1 0490231

(51) Int. Cl.
*G09G 3/3225* (2016.01)
*G09G 3/32* (2016.01)

(52) U.S. Cl.
CPC ..... *G09G 3/3225* (2013.01); *G09G 3/3266* (2013.01); *G09G 2300/0809* (2013.01);
(Continued)

(58) Field of Classification Search
None
See application file for complete search history.

(56) References Cited

U.S. PATENT DOCUMENTS

2012/0013590 A1* 1/2012 Minami ..... G09G 3/3225
345/211

* cited by examiner

*Primary Examiner* — Kenneth B Lee, Jr.
(74) *Attorney, Agent, or Firm* — Harness, Dickey & Pierce, P.L.C.

(57) ABSTRACT

Disclosed is a pulse signal combination circuit for combining N input pulse signals sequentially effective within each display period into an output pulse signal, N being an integer greater than 1, including N output control units and a pulse signal output end. A first control end of an $n^{th}$ output control unit is configured to receive an $n^{th}$ input pulse signal, a second control end thereof is configured to receive an $(n+1)^{th}$ input pulse signal, and an output end thereof is connected to the pulse signal output end. The $n^{th}$ output control unit is configured to, within a time duration of each display period after the $n^{th}$ input pulse signal is effective for the first time and before the $(n+1)^{th}$ input pulse signal is effective for the first time, output the $n^{th}$ input pulse signal to the pulse signal output end, where n is a positive integer less than N.

18 Claims, 3 Drawing Sheets

(52) U.S. Cl.
CPC ..... *G09G 2310/0213* (2013.01); *G09G 2310/0218* (2013.01)

PULSE SIGNAL COMBINATION CIRCUIT, DISPLAY PANEL AND DISPLAY DEVICE

CROSS-REFERENCE TO RELATED APPLICATION

This application is the U.S. national phase of PCT Application No. PCT/CN2015/070193 filed on Jan. 6, 2015, which claims a priority of the Chinese Patent Application No. 201410490231.5 filed on Sep. 23, 2014, the disclosures of which are incorporated in their entirety by reference herein.

TECHNICAL FIELD

The present disclosure relates to the field of display technology, in particular to a pulse signal combination circuit, a display panel and a display device.

BACKGROUND

For an organic light-emitting diode (OLED) display panel, it is required to combine a plurality of single-pulse driving signals which are effective in a time-division manner and have different pulse widths into a multiple-pulse gate driving signal, so as to meet the need of pixel compensation. However, based on the principle of single pulses, it is very difficult to generate the multiple-pulse gate driving signal with a single unit circuit in the related art. In addition, for a large-sized OLED display panel, when a gate driver circuit is merely used to generate the single-pulse gate driving signal, more thin film transistors (TFTs) are required to drive pixels. As a result, a pixel structure of the OLED display panel will be complex and an effective light-emitting area of the OLED will be reduced.

SUMMARY

A main object of the present disclosure is to provide a pulse signal combination circuit, a display panel and a display device, so as to achieve a multiple-pulse output by directly adding OR units in an existing single-pulse signal generation circuit, thereby to combine a plurality of single-pulse signals without any losses.

In one aspect, the present disclosure provides in one embodiment a pulse signal combination circuit for combining N input pulse signals into an output pulse signal, the N input pulse signals being sequentially effective within each display period, and N being an integer greater than 1. The pulse signal combination circuit includes N output control units and a pulse signal output end. A first control end of an $n^{th}$ output control unit is configured to receive an $n^{th}$ input pulse signal, a second control end thereof is configured to receive an $(n+1)^{th}$ input pulse signal, and an output end thereof is connected to the pulse signal output end. The $n^{th}$ output control unit is configured to, within a time duration of each display period after the $n^{th}$ input pulse signal is effective for the first time and before the $(n+1)^{th}$ input pulse signal is effective for the first time, output the $n^{th}$ input pulse signal to the pulse signal output end, where n is a positive integer less than N. A first control end of an $N^{th}$ output control unit is configured to receive an $N^{th}$ input pulse signal, a second control end thereof is configured receive a first input pulse signal, and an output end thereof is connected to the pulse signal output end. The $N^{th}$ output control unit is configured to, within a time duration after the $N^{th}$ input pulse signal is effective for the first time within each display period and before the first input pulse signal is effective for the first time within a next display period, output the $N^{th}$ input pulse signal to the pulse signal output end.

Alternatively, each output control unit includes: a first output control transistor, a gate electrode and a first electrode of which are connected to the first control end of the output control unit; a second output control transistor, a gate electrode of which is connected to the second control end of the output control unit, a first electrode of which is connected to a second electrode of the first output control transistor, and a second electrode of which is configured to receive a first level; and a third output control transistor, a gate electrode of which is connected to the second electrode of the first output control transistor, a first electrode of which is connected to the first control end, and a second electrode of which is connected to the pulse signal output end. When the second output control transistor is turned on and the gate electrode of the third output control transistor is configured to receive the first level, the third output control transistor is turned off.

Alternatively, the N input pulse signals are all positive pulse signals, the first, second and third output control transistors are all n-type TFTs, and the first level is a low level; or the N input pulse signals are all negative pulse signals, the first, second and third output control transistors are all p-type TFTs, and the first level is a high level.

Alternatively, the pulse signal combination circuit further includes an output ineffectiveness control unit configured to receive the N input pulse signals, connected to the pulse signal output end, and configured to, when the N input pulse signals are ineffective, output an ineffective level signal to the pulse signal output end.

Alternatively, the output ineffectiveness control unit includes a gate potential control transistor, an ineffectiveness control transistor, and N effectiveness control transistor configured to receive the N input pulse signals, respectively. A gate electrode and a first electrode of the gate potential control transistor are configured to receive a second level. A gate electrode of the ineffectiveness control transistor is connected to a second electrode of the gate potential control transistor, a first electrode thereof is connected to the pulse signal output end, and a second electrode thereof is configured to receive the first level. A gate electrode of an $m^{th}$ effectiveness control transistor is configured to receive an $m^{th}$ input pulse signal, a first electrode thereof is connected to the gate electrode of the ineffectiveness control transistor, and a second electrode thereof is configured to receive a third level, where m is a positive integer less than or equal to N. The second level is used to turn on the gate potential control transistor. When the $m^{th}$ input pulse signal is effective, the $m^{th}$ effectiveness control transistor is turned on, so as to enable the gate electrode of the ineffectiveness control transistor to receive the third level, thereby to turn off the ineffective control transistor. When the N input pulse signals are all ineffective, the gate electrode of the ineffectiveness control transistor is configured to receive the second level, so as to enable the ineffectiveness control transistor to be turned on and enable the pulse signal output end to receive the first level.

Alternatively, the N input pulse signals are all positive pulse signals, the gate potential control transistor, the ineffectiveness control transistor and the N effectiveness control transistors are all n-type TFTs, the first level is a low level, the second low level is a high level, and the third level is a low level; or the N input pulse signals are all negative pulse signals, the gate potential control transistor, the ineffectiveness control transistor and the N effectiveness control transistors are all p-type TFTs, the first level is a high level, the second level is a low level and the third level is a high level.

Alternatively, when the n-type TFTs are depletion-type TFTs, the third level is less than the first level, and when the n-type TFTs are enhancement-type TFTs, the third level is equal to the first level.

In another aspect, the present disclosure provides in one embodiment a display panel including the above-mentioned pulse signal combination circuit, which is configured to provide the display panel with a gate driving signal through a pulse signal output end.

Alternatively, the display panel is an OLED display panel.

In yet another aspect, the present disclosure provides in one embodiment a display device including the above-mentioned display panel.

According to the pulse signal combination circuit, the display panel and the display device in the embodiments of the present disclosure, the plurality of single-pulse signals (e.g., single-pulse gate driving signals for a single-pulse gate driving circuit) may be combined as the output pulse signal. As a result, it is able to achieve the multiple-pulse output by directly adding OR units to an existing single-pulse signal generation circuit without any other special changes thereto, thereby to combine the plurality of single-pulse signals without any losses. When the pulse signal combination circuit is applied to combine the single-pulse gate driving signals for the single-pulse gate driving circuit as the multiple-pulse gate driving signal, it is able to achieve the multiple-pulse output by directly adding OR units to the existing single-pulse gate driver circuit without any other special changes thereto.

DETAILED DESCRIPTION

Figure 1:
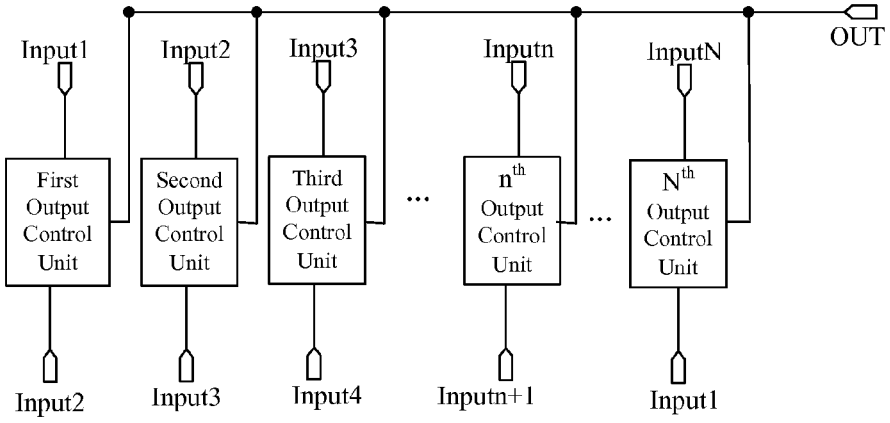
FIG. 1 is a block diagram of a pulse signal combination circuit according to one embodiment of the present disclosure.

The present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may obtain, without any creative effort, the other embodiments, which also fall within the scope of the present disclosure.

Transistors adopted in all the embodiments of the present disclosure may be thin film transistors (TFTs), or field effect transistors (FETs), or any other elements having the same characteristics. In order to differentiate two electrodes other than a gate electrode, one of the two electrodes is referred to as a source electrode, and the other is referred to as a drain electrode. During the implementation, the transistor may be an n-type or a p-type transistor.

The present disclosure provides in one embodiment a pulse signal combination circuit for combining N input pulse signals into an output pulse signal, the N input pulse signals being sequentially effective within each display period, and N being an integer greater than 1. The pulse signal combination circuit includes N output control units and a pulse signal output end.

A first control end of an $n^{th}$ output control unit is configured to receive an $n^{th}$ input pulse signal, a second control end thereof is configured to receive an $(n+1)^{th}$ input pulse signal, and an output end thereof is connected to the pulse signal output end. The $n^{th}$ output control unit is configured to, within a time duration of each display period after the $n^{th}$ input pulse signal is effective for the first time and before the $(n+1)^{th}$ input pulse signal is effective for the first time, output the $n^{th}$ input pulse signal to the pulse signal output end, where n is a positive integer less than N.

A first control end of an $N^{th}$ output control unit is configured to receive an $N^{th}$ input pulse signal, a second control end thereof is configured receive a first input pulse signal, and an output end thereof is connected to the pulse signal output end. The $N^{th}$ output control unit is configured to, within a time duration after the $N^{th}$ input pulse signal is effective for the first time within each display period and before the first input pulse signal is effective for the first time within a next display period, output the $N^{th}$ input pulse signal to the pulse signal output end.

According to the pulse signal combination circuit in the embodiment of the present disclosure, the plurality of single-pulse signals (e.g., single-pulse gate driving signals for a single-pulse gate driving circuit) may be combined as the output pulse signal. As a result, it is able to achieve the multiple-pulse output by directly adding OR units, i.e., the output control units, to an existing single-pulse signal generation circuit without any other special changes thereto, thereby to combine the plurality of single-pulse signals without any losses.

When the pulse signal combination circuit is applied to combine the single-pulse gate driving signals for the single-pulse gate driving circuit as the multiple-pulse gate driving signal, it is able to achieve the multiple-pulse output by directly adding OR units to the existing single-pulse gate driving circuit without any other special changes thereto.

When the pulse signal combination circuit is applied to an OLED display panel, it is able to reduce a size of a bezel of the OLED display panel, the production cost of a gate driver integrated circuit (IC) and the risk of defective bonding of the gate driver IC, thereby to improve the yield of the OLED display panel.

FIG. 1 shows a pulse signal combination circuit according to one embodiment of the present disclosure, which is configured to combine N input pulse signals into an output pulse signal. The N input pulse signals are sequentially effective within each display period, and N is an integer greater than 1. The pulse signal combination circuit includes N output control units (a first output control unit, a second output control unit, a third output control unit, an $n^{th}$ output control unit and an $N^{th}$ output control unit are merely shown in FIG. 1) and a pulse signal output end OUT.

As shown in FIG. 1, a first control end of the first output control unit is configured to receive a first input pulse signal Input1, a second control end thereof is configured to receive a second input pulse signal Input2, and an output end thereof is connected to the pulse signal output end OUT. The first output control unit is configured to, within a time duration of each display period after the first input pulse signal Input1 is effective for the first time and before the second input pulse signal Input2 is effective for the first time, output the first input pulse signal Input1 to the pulse signal output end OUT.

A first control end of a second output control unit is configured to receive the second input pulse signal Input2, a second control end thereof is configured to receive a third input pulse signal Input3, and an output end thereof is connected to the pulse signal output end OUT. The second output control unit is configured to, within a time duration of each display period after the second input pulse signal Input2 is effective for the first time and before the third input pulse signal Input3 is effective for the first time, output the second input pulse signal Input2 to the pulse signal output end OUT.

A first control end of a third output control unit is configured to receive the third input pulse signal Input3, a second control end thereof is configured to receive a fourth input pulse signal Input4, and an output end thereof is connected to the pulse signal output end OUT. The third output control unit is configured to, within a time duration of each display period after the third input pulse signal Input3 is effective for the first time and before the fourth input pulse signal Input4 is effective for the first time, output the third input pulse signal Input3 to the pulse signal output end OUT.

A first control end of the $n^{th}$ output control unit is configured to receive an $n^{th}$ input pulse signal Inputn, a second control end thereof is configured to receive an $(n+1)^{th}$ input pulse signal Inputn+1, and an output end thereof is connected to the pulse signal output end OUT. The $n^{th}$ output control unit is configured to, within a time duration of each display period after the $n^{th}$ input pulse signal Inputn is effective for the first time and before the $(n+1)^{th}$ input pulse signal Inputn+1 is effective for the first time, output the $n^{th}$ input pulse signal Inputn to the pulse signal output end OUT, where n is a positive integer less than N.

A first control end of the $N^{th}$ output control unit is configured to receive an $N^{th}$ input pulse signal InputN, a second control end thereof is configured receive the first input pulse signal Input1, and an output end thereof is connected to the pulse signal output end OUT. The $N^{th}$ output control unit is configured to, within a time duration after the $N^{th}$ input pulse signal InputN is effective for the first time within each display period and before the first input pulse signal Input1 is effective for the first time within a next display period, output the $N^{th}$ input pulse signal InputN to the pulse signal output end OUT.

To be specific, each output control unit includes: a first output control transistor, a gate electrode and a first electrode of which are connected to the first control end of the output control unit; a second output control transistor, a gate electrode of which is connected to the second control end of the output control unit, a first electrode of which is connected to a second electrode of the first output control transistor, and a second electrode of which is configured to receive a first level; and a third output control transistor, a gate electrode of which is connected to the second electrode of the first output control transistor, a first electrode of which is connected to the first control end, and a second electrode of which is connected to the pulse signal output end. When the second output control transistor is turned on and the gate electrode of the third output control transistor is configured to receive the first level, the third output control transistor is turned off.

Figure 2:
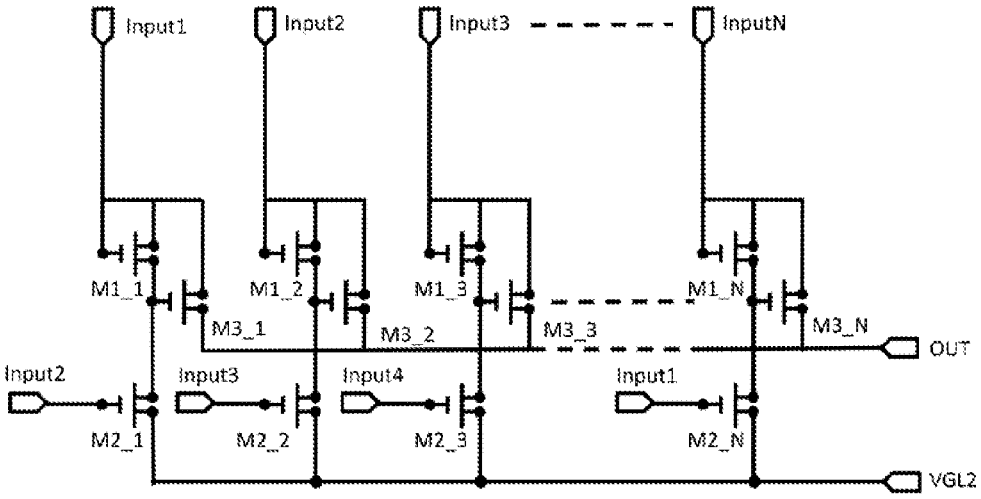
FIG. 2 is a circuit diagram of a pulse signal combination circuit according to one embodiment of the present disclosure.

To be specific, as shown in FIG. 2, the N output control units are of a structure identical to each other. When the N input pulse signals are all positive pulse signals, the transistors adopted by the pulse signal combination circuit are all n-type TFTs.

The first output control unit includes: a first output control transistor M1_1, a gate electrode and a first electrode of which are connected to the first control end of the first output control unit; and the first control end of the first output control unit being configured to receive the first input pulse signal Input1; a second output control transistor M2_1, a gate electrode of which is connected to the second control end of the first output control unit, a first electrode of which is connected to a second electrode of the first output control transistor M1_1, and a second electrode of which is configured to receive a low level VGL2, the second control end of the first output control unit being configured to receive the second input pulse signal Input2; and a third output control transistor M3_1, a gate electrode of which is connected to the second electrode of the first output control transistor M1_1, a first electrode of which is connected to the first control end, and a second electrode of which is connected to the pulse signal output end OUT. When the second output control transistor M2_1 is turned on and the gate electrode of the third output control transistor M3_1 is configured to receive the low level VGL2, the third output control transistor M3_1 is turned off.

During the actual operation, within each display period, when Input1 is a high level (i.e., Input1 is effective) and Input2 is a low level (i.e., Input2 is ineffective), M1_1 and M3_1 are both turned on, and M2_1 is turned off, so as to pull up a signal outputted to OUT. At this time, the gate electrode of M3_1 is at a high level. When Input1 is pulled down to a low level, M1_1 is turned off. However, the gate electrode of M3_1 is still maintained at the high level and M3_1 is maintained in an ON state. At this time, Input1, i.e., the low level, is continuously outputted to OUT through M3_1, and the signal outputted to OUT is pulled down until Input2 is a high level and M2_1 is turned on, so as to pull down a potential of the gate electrode of M3_1 to be the low level VGL2 and turn off M3_1. Within a rest time of this display period, the first output control unit stops working.

As shown in FIG. 2, the second output control unit consists of M1_2, M2_2 and M3_2. A gate electrode of M1_2 is configured to receive Input2, a gate electrode of M2_2 is configured to receive Input3, a second electrode of M3_2 is connected to OUT, and a second electrode of M2_2 is configured to receive the low level VGL2.

Within each display period, when Input2 is a high level (i.e., Input2 is effective) and Input3 is a low level (i.e., Input 3 is ineffective), M1_2 and M3_2 are both turned on and M2_2 is turned off, so as to pull up a signal outputted to OUT. At this time, the gate electrode of M3_2 is at a high level. When Input2 is pulled down to a low level, M1_2 is turned off. However, the gate electrode of M3_2 is maintained at the high level, and M3_2 is maintained in the ON state. At this time, Input2, i.e., the low level, is continuously outputted to OUT through M3_2, and the signal outputted to OUT is pulled down until Input3 is a high level and M2_2 is turned on, so as to pull down a potential of the gate electrode of M3_2 to the low level VGL2 and turn off M3_2. In other words, within a rest time of this display period, the second output control unit stops workings.

As shown in FIG. 2, the third output control unit consists of M1_3, M2_3 and M3_3. A gate electrode of M1_3 is configured to receive Input3, a gate electrode of M2_3 is configured to receive Input4, a second electrode of M3_3 is connected to OUT, and a second electrode M2_3 is configured to receive the low level VGL2.

Within each display period, when Input3 is a high level (i.e., Input3 is effective) and Input4 is a low level (i.e., Input4 is ineffective), M1_3 and M3_3 are both turned on, and M2_3 is turned off, so as to pull up a signal outputted to OUT. At this time, the gate electrode of M3_3 is at a high level. When Input3 is pulled down to a low level, M1_3 is turned off. However, the gate electrode of M3_3 is maintained at the high level, and M3_3 is maintained in the ON state. At this time, Input3, i.e., the low level, is continuously outputted to OUT through M3_3, and the signal outputted to OUT is pulled down until Input4 is a high level and M2_3 is turned on, so as to pull down a potential of the gate electrode of M3_3 to the low level VGL2 and turn off M3_3. In other words, within a rest time of this display period, the third output control unit stops working.

The working procedures of the fourth output control unit to the $(N-1)^{th}$ output control unit are similar to those mentioned above.

As shown in FIG. 2, the $N^{th}$ output control unit consists of M1_N, M2_N and M3_N. A gate electrode of M1_N is configured to receive InputN, a gate electrode of M2_N is configured to receive Input1, a second electrode of M3_N is connected to OUT, and a second electrode of the M2_N is configured to receive the low level VGL2.

Within each display period, when InputN is a high level (i.e., InputN is effective) and Input1 is a low level (i.e., Input1 is ineffective), M1_N and M3_N are both turned on, and M2_N is turned off, so as to pull up a signal outputted to OUT. At this time, the gate electrode of M3_N is at a high level. When InputN is pulled down to a low level, M1_N is turned off. However, the gate electrode of M3_N is maintained at the high level, and M3_N is maintained in the ON state. At this time, Input, i.e., the low level, is continuously outputted to OUT through M3_N, and the signal outputted to OUT is pulled down until Input1 is a high level within a next display period and M2_N is turned on, so as to pull down the potential of the gate electrode of M3_N to the low level VGL2 and turn off M3_N. In other words, the $N^{th}$ output control unit stops working.

Figure 3:
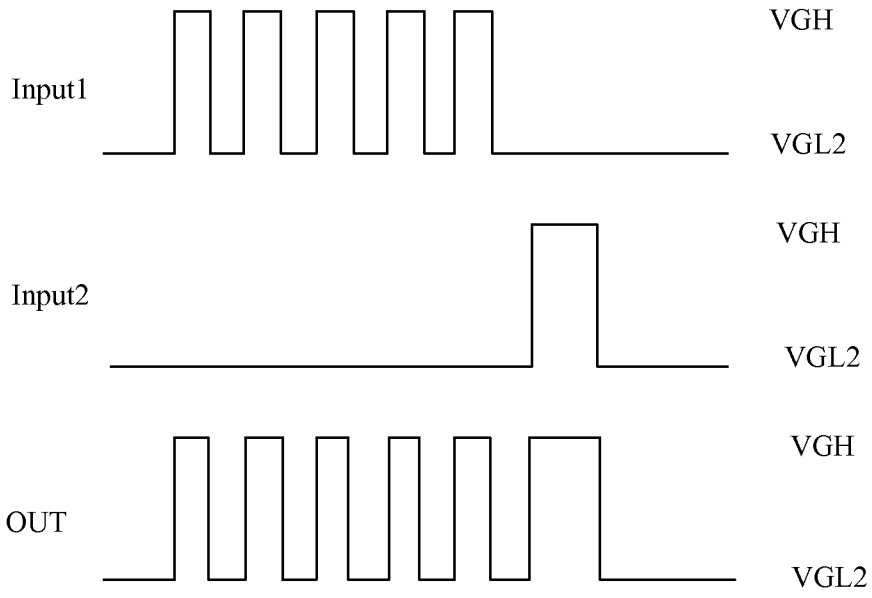
FIG. 3 is a sequence diagram of a first positive input pulse signal Input1, a second positive input pulse signal Input2 and a signal outputted by a pulse signal output end OUT adopted by a pulse signal combination circuit according to one embodiment of the present disclosure.

FIG. 3 is a sequence diagram of the first input pulse signal Input1, the second input pulse signal Input2 and the signal outputted by the pulse signal output end OUT adopted by the pulse signal combination circuit when N is 2 and Input1 and Input2 are both positive pulse signals.

Figure 4:
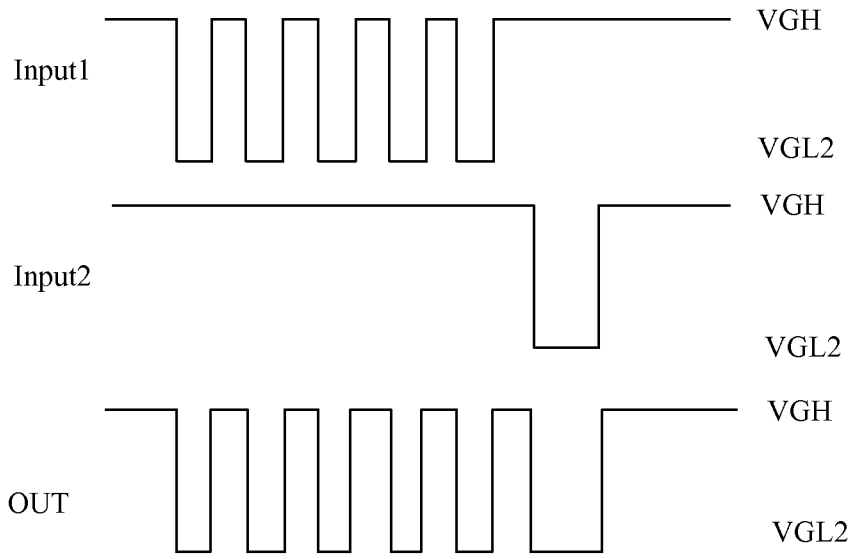
FIG. 4 is a sequence diagram of a first negative input pulse signal Input1, a second negative input pulse signal Input2 and a signal outputted by the pulse signal output end OUT adopted by a pulse signal combination circuit according to one embodiment of the present disclosure.

In another embodiment, when the N input pulse signals are all negative pulse signals, all the transistors in FIG. 2 may be replaced with p-type TFTs. Electrical parameters of the p-type TFT are completely different from those of the n-type TFT, so it is required to change a size of the TFT and replace the low level VGL2 in FIG. 2 with a high level VGH, so as to combine the negative pulse signals without any losses. FIG. 4 is a sequence diagram of the first input pulse signal Input1, the second input pulse signal Input2 and the signal outputted by the pulse signal output end OUT adopted by the pulse signal combination circuit when N is 2 and Input1 and Input2 are both negative pulse signals.

For the pulse signal combination circuit in FIG. 2, during the actual operation, due to electric leakage of the TFT, the gate electrode of the third control transistor cannot be maintained at a high level when it is required to pull down the output pulse signal. Hence, an output ineffectiveness control unit is further provided in the embodiments of the present disclosure so as to pull down the output pulse signal.

Alternatively, the pulse signal combination circuit further includes an output ineffectiveness control unit configured to receive the N input pulse signals, connected to the pulse signal output end, and configured to, when the N input pulse signals are ineffective, output an ineffective level signal to the pulse signal output end.

To be specific, the output ineffectiveness control unit includes a gate potential control transistor, an ineffectiveness control transistor, and N effectiveness control transistor configured to receive the N input pulse signals, respectively. A gate electrode and a first electrode of the gate potential control transistor are configured to receive a second level. A gate electrode of the ineffectiveness control transistor is connected to a second electrode of the gate potential control transistor, a first electrode thereof is connected to the pulse signal output end, and a second electrode thereof is configured to receive the first level. A gate electrode of an $m^{th}$ effectiveness control transistor is configured to receive an $m^{th}$ input pulse signal, a first electrode thereof is connected to the gate electrode of the ineffectiveness control transistor, and a second electrode thereof is configured to receive a third level, where m is a positive integer less than or equal to N. The second level is used to turn on the gate potential control transistor. When the $m^{th}$ input pulse signal is effective, the $m^{th}$ effectiveness control transistor is turned on, so as to enable the gate electrode of the ineffectiveness control transistor to receive the third level, thereby to turn off the ineffective control transistor. When the N input pulse signals are all ineffective, the gate electrode of the ineffectiveness control transistor is configured to receive the second level, so as to enable the ineffectiveness control transistor to be turned on and enable the pulse signal output end to receive the first level.

Figure 5:
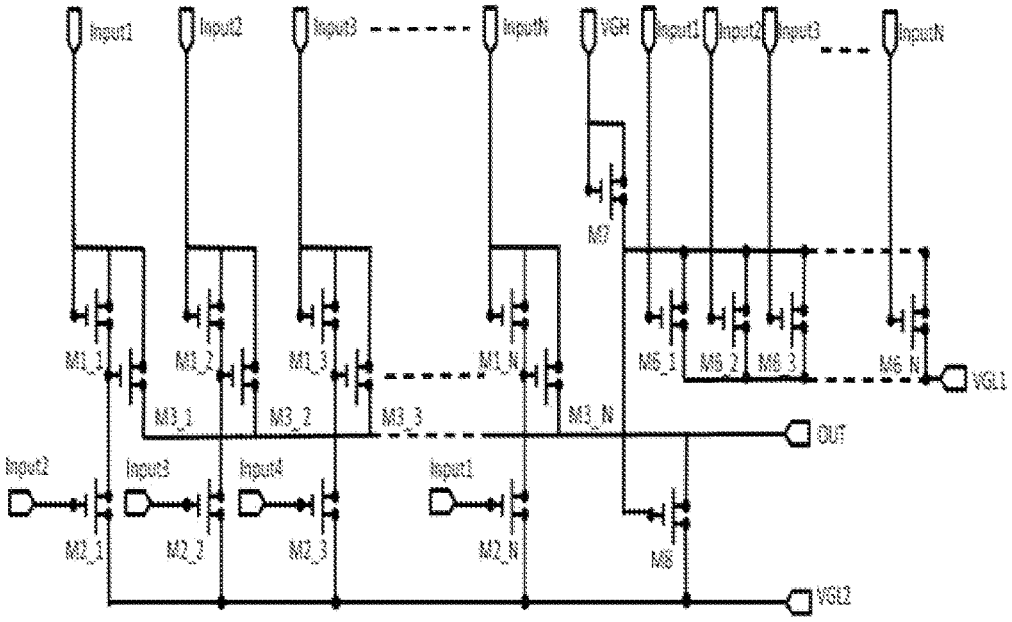
FIG. 5 is another circuit diagram of a pulse signal combination circuit according to one embodiment of the present disclosure.

In an alternative embodiment, as shown in FIG. 5, the N input pulse signals are all positive pulse signals, and all the transistors adopted by the pulse signal combination circuit are n-type TFTs.

On the basis of FIG. 2, the pulse signal combination circuit in FIG. 5 further includes an output ineffectiveness control unit, which includes a gate potential control transistor M7, an ineffectiveness control transistor M8, and N effectiveness control transistor configured to receive the N input pulse signals (in FIG. 5, M6_1 represents a first effectiveness control transistor, M6_2 represents a second effectiveness control transistor, M6_3 represents a third effectiveness control transistor, and M6_N represents an $N^{th}$ effectiveness control transistor), respectively.

A gate electrode and a first electrode of the gate potential control transistor M7 are configured to receive the high level VGH. A gate electrode of the ineffectiveness control transistor M8 is connected to a second electrode of the gate potential control transistor M7, a first electrode thereof is connected to the pulse signal output end OUT, and a second electrode thereof is configured to receive the low level VGL2. A gate electrode of the first effectiveness control transistor M6_1 is configured to receive the first input pulse signal Input1, a first electrode thereof is connected to the gate electrode of the ineffectiveness control transistor M8, and a second electrode thereof is configured to receive a low level VGL1. A gate electrode of the second effectiveness control transistor M6_2 is configured to receive the second input pulse signal Input2, a first electrode thereof is connected to the gate electrode of the ineffectiveness control transistor M8, and a second electrode thereof is configured to receive the low level VGL1. A gate electrode of the third effectiveness control transistor M6_3 is configured to receive the third input pulse signal Input3, a first electrode thereof is connected to the gate electrode of the ineffectiveness control transistor M8, and a second electrode thereof is configured to receive the low level VGL1. A gate electrode of the $N^{th}$ effectiveness control transistor M6_N is configured to receive the $N^{th}$ input pulse signal InputN, a first electrode thereof is connected to the gate electrode of the ineffectiveness control transistor M8, and a second electrode thereof is configured to receive the low level VGL1.

When any input pulse signal is a high level, the effectiveness control transistor which receives this input pulse signal is turned on, so as to enable the gate electrode of the ineffectiveness control transistor to receive the low level VGL1, thereby to turn off the ineffectiveness control transistor M8.

When the N input pulse signals are each a low level, the gate electrode of the ineffectiveness control transistor M8 receives the high level VGH, so as to turn on the ineffectiveness control transistor M8. At this time, the pulse signal output end OUT receives the low level VGL2, so as to pull down the output pulse signal. In this way, even when there is the electric leakage for the gate electrode of M3_N, i.e., when it is impossible to output a low level (i.e., VGL2) signal through a common input control unit, it is still able to pull down the output pulse signal.

When n-channel depletion-type TFTs are adopted by the pulse signal combination circuit, VGL1 is less than VGL2. For example, VGL1 usually has a value of −10V, and VGL2 usually has a value of −5V. When n-channel enhancement-type TFTs are adopted by the pulse signal combination circuit, VGL1 may be equal to VGL2. For example, VGL1 and VGL2 may both be −5V.

Figure 6:
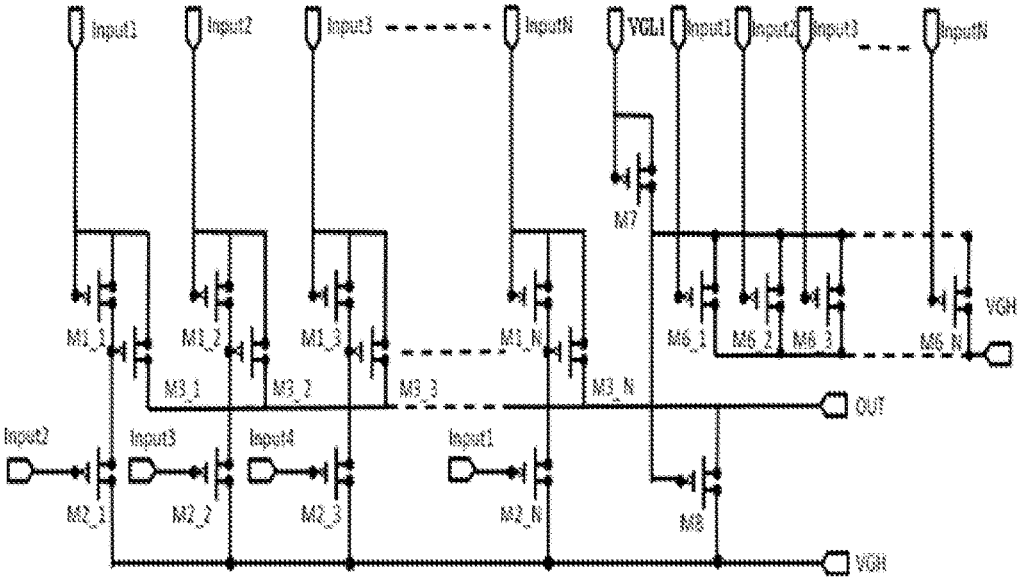
FIG. 6 is yet another circuit diagram of a pulse signal combination circuit according to one embodiment of the present disclosure.

In another embodiment, as shown in FIG. 6, when the N input pulse signals are all negative pulse signals, all the transistors in FIG. 5 may be replaced with p-type TFTs. Electrical parameters of the p-type TFT are completely different from those of the n-type TFT, so it is required to change a size of the TFT, replace the low levels VGL2 and VGL1 in FIG. 5 with the high level VGH and replace the high level VGH in FIG. 5 with the low level VGL1, so as to combine the negative pulse signals without any losses.

The present disclosure further provides in one embodiment a display panel including the above-mentioned pulse signal combination circuit, which is configured to provide the display panel with a gate driving signal through the pulse signal output end. Alternatively, the display panel is an OLED display panel.

The present disclosure further provides in one embodiment a display device including the above-mentioned display panel.

The above are merely the preferred embodiments of the present disclosure. It should be appreciated that, a person skilled in the art may make further modifications and improvements without departing from the principle of the present disclosure, and these modifications and improvements shall also fall within the scope of the present disclosure.

What is claimed is:

1. A pulse signal combination circuit for combining N input pulse signals into an output pulse signal, the N input pulse signals being sequentially effective within each display period, N being an integer greater than 1, the pulse signal combination circuit comprising N output control units and a pulse signal output end, wherein a first control end of an $n^{th}$ output control unit is configured to receive an $n^{th}$ input pulse signal, a second control end of the $n^{th}$ output control unit is configured to receive an $(n+1)^{th}$ input pulse signal, and an output end of $n^{th}$ output control unit is connected to the pulse signal output end;

the $n^{th}$ output control unit is configured to, within a time duration of each display period after the $n^{th}$ input pulse signal is effective for the first time and before the $(n+1)^{th}$ input pulse signal is effective for the first time, output the $n^{th}$ input pulse signal to the pulse signal output end, where n is a positive integer less than N;

a first control end of an $N^{th}$ output control unit is configured to receive an $N^{th}$ input pulse signal, a second control end of the $N^{th}$ output control unit is configured receive a first input pulse signal, and an output end of the $N^{th}$ output control unit is connected to the pulse signal output end; and the $N^{th}$ output control unit is configured to, within a time duration after the Nth input pulse signal is effective for the first time within each display period and before the first input pulse signal is effective for the first time within a next display period, output the $N^{th}$ input pulse signal to the pulse signal output end.

2. The pulse signal combination circuit according to claim 1, wherein each output control unit comprises:

a first output control transistor, a gate electrode and a first electrode of which are connected to the first control end of the output control unit;

a second output control transistor, a gate electrode of which is connected to the second control end of the output control unit, a first electrode of which is connected to a second electrode of the first output control transistor, and a second electrode of which is configured to receive a first level; and a third output control transistor, a gate electrode of which is connected to the second electrode of the first output control transistor, a first electrode of which is connected to the first control end, and a second electrode of which is connected to the pulse signal output end, wherein when the second output control transistor is turned on and the gate electrode of the third output control transistor is configured to receive the first level, the third output control transistor is turned off.

3. The pulse signal combination circuit according to claim 2, wherein the N input pulse signals are all positive pulse signals, the first, second and third output control transistors are all n-type thin film transistors (TFTs), and the first level is a low level; or the N input pulse signals are all negative pulse signals, the first, second and third output control transistors are all p-type TFTs, and the first level is a high level.

4. The pulse signal combination circuit according to claim 1, further comprising:

an output ineffectiveness control unit configured to receive the N input pulse signals, connected to the pulse signal output end, and configured to, when the N input pulse signals are all ineffective, output an ineffective level signal to the pulse signal output end.

5. The pulse signal combination circuit according to claim 4, wherein the output ineffectiveness control unit comprises a gate potential control transistor, an ineffectiveness control transistor, and N effectiveness control transistor configured to receive the N input pulse signals, respectively;

a gate electrode and a first electrode of the gate potential control transistor are configured to receive a second level;

a gate electrode of the ineffectiveness control transistor is connected to a second electrode of the gate potential control transistor, a first electrode of the ineffectiveness control transistor is connected to the pulse signal output end, and a second electrode of the ineffectiveness control transistor is configured to receive the first level;

a gate electrode of an $m^{th}$ effectiveness control transistor is configured to receive an $m^{th}$ input pulse signal, a first electrode of the $m^{th}$ effectiveness control transistor is connected to the gate electrode of the ineffectiveness control transistor, and a second electrode of the $m^{th}$ effectiveness control transistor is configured to receive a third level, wherein m is a positive integer less than or equal to N;

the second level is used to turn on the gate potential control transistor;

when the $m^{th}$ input pulse signal is effective, the $m^{th}$ effectiveness control transistor is turned on, so as to enable the gate electrode of the ineffectiveness control transistor to receive the third level, thereby to turn off the ineffective control transistor; and when the N input pulse signals are all ineffective, the gate electrode of the ineffectiveness control transistor is configured to receive the second level, so as to enable the ineffectiveness control transistor to be turned on and enable the pulse signal output end to receive the first level.

6. The pulse signal combination circuit according to claim 5, wherein the N input pulse signals are all positive pulse signals, the gate potential control transistor, the ineffectiveness control transistor and the N effectiveness control transistors are all n-type TFTs, the first level is a low level, the second low level is a high level, and the third level is a low level; or the N input pulse signals are all negative pulse signals, the gate potential control transistor, the ineffectiveness control transistor and the N effectiveness control transistors are all p-type TFTs, the first level is a high level, the second level is a low level and the third level is a high level.

7. The pulse signal combination circuit according to claim 6, wherein when the n-type TFTs are depletion-type TFTs, the third level is less than the first level, and when the n-type TFTs are enhancement-type TFTs, the third level is equal to the first level.

8. A display panel comprising the pulse signal combination circuit according to claim 1, wherein the pulse signal combination circuit is configured to provide the display panel with a gate driving signal through a pulse signal output end.

9. The display panel according to claim 8, wherein the display panel is an organic light-emitting diode (OLED) display panel.

10. A display device comprising the display panel according to claim 8.

11. The pulse signal combination circuit according to claim 2, further comprising:

an output ineffectiveness control unit configured to receive the N input pulse signals, connected to the pulse signal output end, and configured to, when the N input pulse signals are all ineffective, output an ineffective level signal to the pulse signal output end.

12. The pulse signal combination circuit according to claim 11, wherein the output ineffectiveness control unit comprises a gate potential control transistor, an ineffectiveness control transistor, and N effectiveness control transistor configured to receive the N input pulse signals, respectively;

a gate electrode and a first electrode of the gate potential control transistor are configured to receive a second level;

a gate electrode of the ineffectiveness control transistor is connected to a second electrode of the gate potential control transistor, a first electrode of the ineffectiveness control transistor is connected to the pulse signal output end, and a second electrode of the ineffectiveness control transistor is configured to receive the first level;

a gate electrode of an $m^{th}$ effectiveness control transistor is configured to receive an $m^{th}$ input pulse signal, a first electrode of the $m^{th}$ effectiveness control transistor is connected to the gate electrode of the ineffectiveness control transistor, and a second electrode of the $m^{th}$ effectiveness control transistor is configured to receive a third level, wherein m is a positive integer less than or equal to N;

the second level is used to turn on the gate potential control transistor;

when the $m^{th}$ input pulse signal is effective, the $m^{th}$ effectiveness control transistor is turned on, so as to enable the gate electrode of the ineffectiveness control transistor to receive the third level, thereby to turn off the ineffective control transistor; and when the N input pulse signals are all ineffective, the gate electrode of the ineffectiveness control transistor is configured to receive the second level, so as to enable the ineffectiveness control transistor to be turned on and enable the pulse signal output end to receive the first level.

13. The pulse signal combination circuit according to claim 12, wherein the N input pulse signals are all positive pulse signals, the gate potential control transistor, the ineffectiveness control transistor and the N effectiveness control transistors are all n-type TFTs, the first level is a low level, the second low level is a high level, and the third level is a low level; or the N input pulse signals are all negative pulse signals, the gate potential control transistor, the ineffectiveness control transistor and the N effectiveness control transistors are all p-type TFTs, the first level is a high level, the second level is a low level and the third level is a high level.

14. The pulse signal combination circuit according to claim 13, wherein when the n-type TFTs are depletion-type TFTs, the third level is less than the first level, and when the n-type TFTs are enhancement-type TFTs, the third level is equal to the first level.

15. The pulse signal combination circuit according to claim 3, further comprising:

an output ineffectiveness control unit configured to receive the N input pulse signals, connected to the pulse signal output end, and configured to, when the N input pulse signals are all ineffective, output an ineffective level signal to the pulse signal output end.

16. The pulse signal combination circuit according to claim 15, wherein the output ineffectiveness control unit comprises a gate potential control transistor, an ineffectiveness control transistor, and N effectiveness control transistor configured to receive the N input pulse signals, respectively;

a gate electrode and a first electrode of the gate potential control transistor are configured to receive a second level;

a gate electrode of the ineffectiveness control transistor is connected to a second electrode of the gate potential control transistor, a first electrode of the ineffectiveness control transistor is connected to the pulse signal output end, and a second electrode of the ineffectiveness control transistor is configured to receive the first level;

a gate electrode of an $m^{th}$ effectiveness control transistor is configured to receive an $m^{th}$ input pulse signal, a first electrode of the $m^{th}$ effectiveness control transistor is connected to the gate electrode of the ineffectiveness control transistor, and a second electrode of the $m^{th}$ effectiveness control transistor is configured to receive a third level, wherein m is a positive integer less than or equal to N;

the second level is used to turn on the gate potential control transistor;

when the $m^{th}$ input pulse signal is effective, the $m^{th}$ effectiveness control transistor is turned on, so as to enable the gate electrode of the ineffectiveness control transistor to receive the third level, thereby to turn off the ineffective control transistor; and when the N input pulse signals are all ineffective, the gate electrode of the ineffectiveness control transistor is configured to receive the second level, so as to enable the ineffectiveness control transistor to be turned on and enable the pulse signal output end to receive the first level.

17. The pulse signal combination circuit according to claim 16, wherein the N input pulse signals are all positive pulse signals, the gate potential control transistor, the ineffectiveness control transistor and the N effectiveness control transistors are all n-type TFTs, the first level is a low level, the second low level is a high level, and the third level is a low level; or the N input pulse signals are all negative pulse signals, the gate potential control transistor, the ineffectiveness control transistor and the N effectiveness control transistors are all p-type TFTs, the first level is a high level, the second level is a low level and the third level is a high level.

18. The pulse signal combination circuit according to claim 17, wherein when the n-type TFTs are depletion-type TFTs, the third level is less than the first level, and when the n-type TFTs are enhancement-type TFTs, the third level is equal to the first level.

* * * * *